US006887054B2

(12) United States Patent
Petersen et al.

(10) Patent No.: US 6,887,054 B2
(45) Date of Patent: May 3, 2005

(54) TRANSITION VALVING BY MEANS OF NON-RETURN VALVES

(75) Inventors: Hans Christian Petersen, Nordborg (DK); Jorgen Pedersen, Nordborg (DK)

(73) Assignee: Sauer-Danfoss ApS (DK)

( * ) Notice: Subject to any disclaimer, the term of this patent is extended or adjusted under 35 U.S.C. 154(b) by 12 days.

(21) Appl. No.: 10/801,187

(22) Filed: Mar. 16, 2004

(65) Prior Publication Data

US 2004/0175283 A1 Sep. 9, 2004

Related U.S. Application Data

(62) Division of application No. 10/255,970, filed on Sep. 26, 2002.

(51) Int. Cl.[7] ..... F03C 2/00
(52) U.S. Cl. ..... 418/61.3; 418/171; 418/270
(58) Field of Search ..... 418/61.3, 171, 418/166, 270

(56) References Cited

U.S. PATENT DOCUMENTS

| | | | | |
|---|---|---|---|---|
| 3,514,234 A | | 5/1970 | Albert et al. | |
| 3,775,031 A | | 11/1973 | Hansen et al. | |
| 3,778,198 A | * | 12/1973 | Giversen | 418/61.3 |
| 3,865,519 A | * | 2/1975 | Lepelletier | 418/61.3 |
| 3,892,503 A | * | 7/1975 | Getman | 418/61.3 |
| 3,907,465 A | * | 9/1975 | Dorff et al. | 418/171 |
| 4,767,292 A | * | 8/1988 | Kinder | 418/61.3 |

FOREIGN PATENT DOCUMENTS

| | | | | |
|---|---|---|---|---|
| EP | 412403 A2 | | 2/1991 | |
| EP | 412403 A2 | * | 2/1991 | F04C/2/10 |

* cited by examiner

*Primary Examiner*—Theresa Trieu

(57) ABSTRACT

A rotary fluid pressure device has a first oil passage with relatively high pressure fluid therein surrounding the gear set; a plurality of second oil passageways connecting the first oil passageway to the expanding and contracting oil chambers; and fluid non-return valves in each of the second oil passageways to permit the flow of oil therethrough only in a direction from the oil chambers to the first oil passageway.

1 Claim, 2 Drawing Sheets

TRANSITION VALVING BY MEANS OF NON-RETURN VALVES

CROSS REFERENCE TO A RELATED APPLICATION

This application is a division of U.S. Ser. No. 10/255,970 filed Sep. 26, 2002.

BACKGROUND OF THE INVENTION

A problem exists in gerotor motors when the valving of the volume chambers does not match the volume change in the volume chambers. For example, as one of the volume chambers becomes a maximum volume transition chamber, the valving of the unit will in some situations continue to communicate high pressure fluid into that volume chamber for some more degrees of rotation. The instantaneous result will be that the volume chamber has begun to decrease while still communicating with high pressure. The valving then shuts off and the chamber decreases further. Because of the overlap in the valving, with no way to relieve pressure in the chamber, the fluid pressure will rise rapidly creating a pressure pulse or spike in that volume chamber. This incorrect timing will result in a number of problems in the gerotor, each of which will have a further detrimental effect on volumetric efficiency and motor smoothness. This problem is not specifically related to gerotor motors, but occurs in all hydraulic machines having a separate valving element.

It is therefore a principal object of this invention to provide transition valving through the use of non-return valves within the gear set of a gerotor motor to correct the aforesaid problems.

These and objects will be apparent to those skilled in the art.

SUMMARY OF THE INVENTION

A rotary fluid pressure device has a first oil passage with relatively high pressure fluid therein surrounding the gear set; a plurality of second oil passageways connecting the first oil passageway to the expanding and contracting oil chambers; and fluid non-return valves in each of the second oil passageways to permit the flow of oil therethrough only in a direction from the oil chambers to the first oil passageway.

DESCRIPTION OF THE EMBODIMENTS OF THE INVENTION

Figure 1:
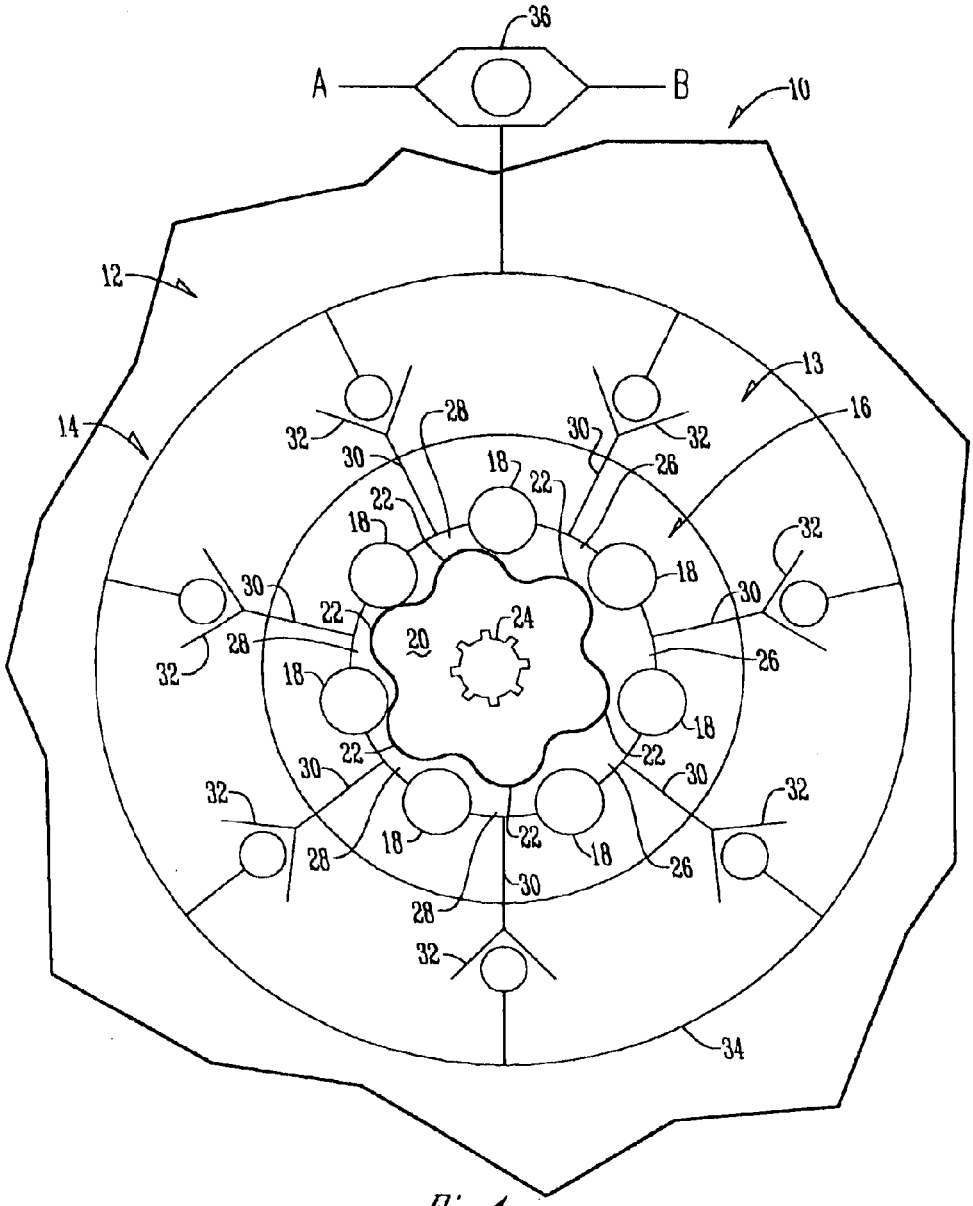
FIG. 1 is a schematic plan view of the gear set of this invention.

FIG. 1 shows a first embodiment of the invention, not specifically related to a gerotor motor, but illustrated in gerotor motor 10. The motor 10 includes a housing 12 continuing the gear set 14 having an interior 13, which includes ring member 16 and internal teeth (rollers) 18. A conventional star member 20 is located within ring member 16 and has teeth 22 and an internally splined opening 24. The numerals 26 and 28 are expanding fluid volume members and contracting fluid volume members, respectively.

Those skilled in the art will understand that the designation of a volume chamber as "expanding" or "contracting" is in reference to its instantaneous, temporary condition, and a particular volume chamber is in one or the other of those conditions for less than half of one orbit of the star 20. As is also well known in the art, the interengagement of the teeth 18 of the ring 16 and star 20 defines a minimum volume transition chamber 28, and a maximum volume transition chamber 26. As the names imply, the minimum volume transition chamber 28 occurs when a volume chamber changes (is in a "transition") from a contracting to an expanding volume chamber, and is at, or very near, its minimum volume. This occurs once for each volume chamber during each orbit of the star 20. Similarly, the maximum volume transition chamber 26 occurs when a volume chamber changes from an expanding to a contracting volume chamber, and is at, or very near, its maximum volume. This also occurs once for each volume chamber during each orbit of the star 20.

The gear set 14 (FIG. 1) with the star member 20 and ring member 16 and seven rollers 18, is supplied with the oil connection, or plurality of second oil passageways, 30 from each volume chamber 26 and 28 to a common oil passage in or in connection with the gear set. Via a high pressure select valve 36, this oil passage, or first oil passage, 34 is connected to the A and B ports of the motor, meaning that the highest pressure supplied to the motor will always act in the oil passage 34. The contracting chambers 28, connected to the motor outlet connection, will be exposed to a low pressure, and the non-return valves 32 will thus be closed. The expanding chambers 26, connect to the motor inlet condition, will be exposed to a high pressure. As the oil passage 34 is also exposed to the same high pressure, the non-return valve 32 might be open or might be closed. This is of no significance for the operation of the motor, as high pressure is high pressure no matter through which passage it is connected to the chamber.

Contracting chambers 28, neither connected to the fluid inlet port, nor the fluid outlet port of the motor, are of concern. Trapped oil in these chambers will connect to the oil passage through the non-return valves 32, as soon as the pressure rises above the high-pressure level. Pressure peaks will thus be avoided.

Figure 2:
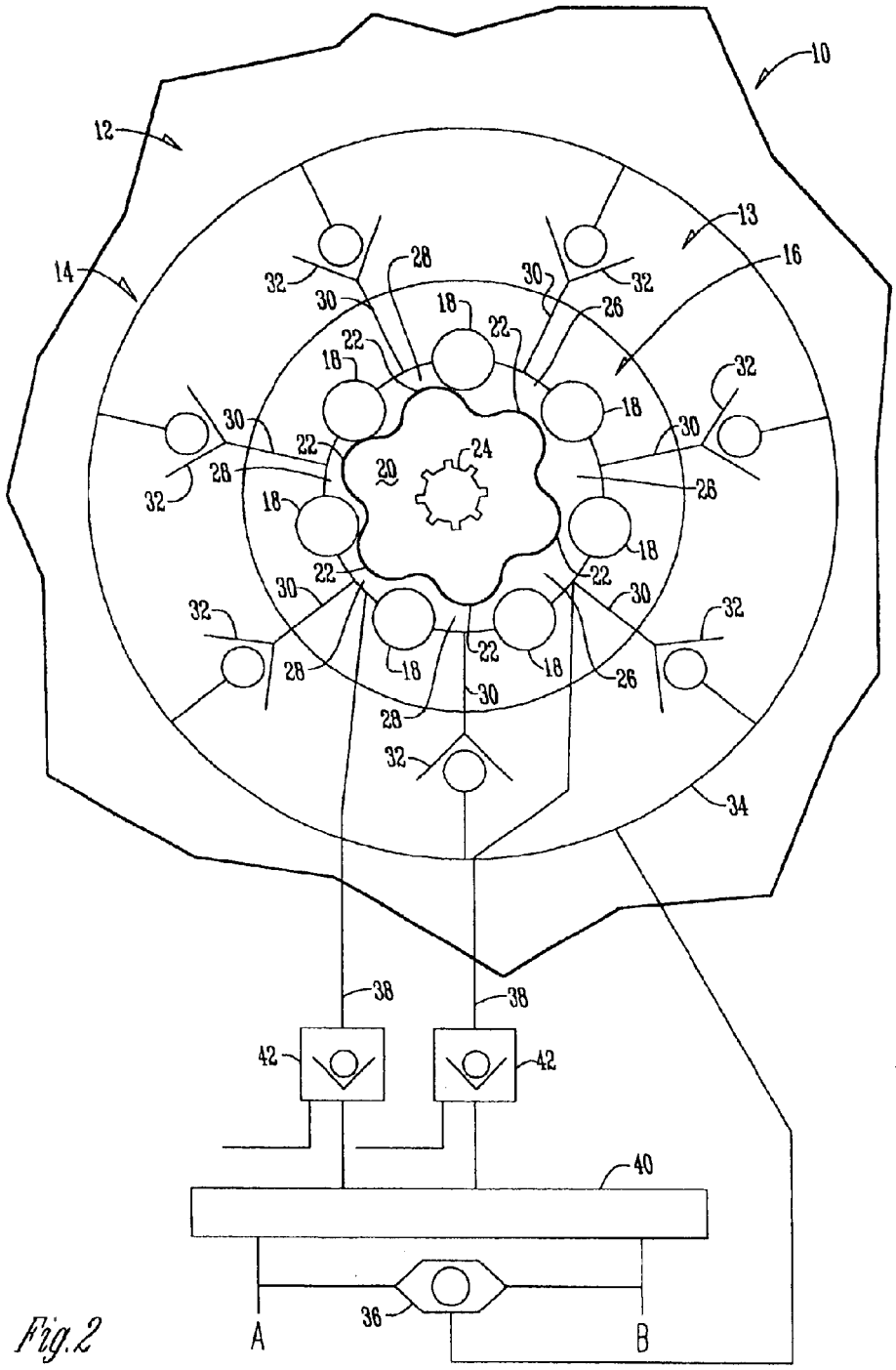
FIG. 2 is a view similar to FIG. 1 but shows additional hydraulic circuitry.

FIG. 2 shows the gear set of FIG. 1, and show in addition a schematic view of the valving of the motor. Each volume chamber of the gear set is connected through a passage 38 with the valving 40. (Only two of the connections are shown.) In these two passages, or third fluid passageways, 38, a pilot operated check valve 42 is placed, meaning that flow from valving 42 to the gear set 14 is always possible, and flow from gear set to the valving 40 is selectively on or off.

Check valve 32 will communicate fluid from the volume chambers 28 to the fluid passageway 34, when the oil pressure in a volume chamber 28 rises above the level of pressure in fluid passageway 34. This will be the case, when ordinary valving to a contracting volume chamber is shut off, whereby fluid will be trapped in the chamber and compressed due to the contraction. As the pressure in the contracting volume chamber reaches the level of pressure in the fluid passageway 34, further compressing of the fluid is avoided, and thus pressure peaks are avoided.

Check valve 42 is a controlled on/off valve between ordinary valving 40 and volume chambers 28. When this valve is open, the valving of the motor will communicate with all volume chambers, and the function of the motor will be normal. If one of the valves 42 is closed, fluid communication between ordinary valving 40 and this volume chamber will only be possible when the pressure from the valving is higher than the pressure in the volume chamber. This means that fluid will be communicated from the valving to the volume chamber when it is expanding, but not when it is contracting. Fluid from the volume chamber will, when it is contracting, be compressed, and thus led to the fluid passage 34 through check valve 32.

Passageway 34 is communicating with the high-pressure inlet to the motor, whereby fluid will be returned to the motor fluid inlet. The volume chamber is basically idling, whereby fluid consumed during expanding is retuned during contracting. The number of working volume chambers is thus reduced, whereby the displacement of the motor is reduced. Lower displacement means higher revolution at lower torque, when pressure and flow across the motor is maintained.

Having only one volume chamber supplied with a valve 42 gives the possibility of shifting between two different displacements. Having two volume chamber supplied with a valve 42 gives the possibility of shifting between three different displacements, having three gives four different displacements and so on.

When the pilot operated check valves 42 are open, oil communication between gear set 14 and valving occurs like in an ordinary motor. However, when the pilot operated check valve 42 to a volume chamber is closed, this chamber will be unable to communicate oil from a contracting chamber to the valving, and further to the outlet of the motor. Instead, oil in the contracting chamber 28 will be compressed and consequently led to the oil passage through the non-return valve 32 for that chamber. Thus oil in a contracting chamber 28 is returned to the high-pressure side, and the displacement of the gear set will be reduced. Closing the pilot operated check valves 42 in more than one passage 38 between gear set and valving will further reduce the displacement of the motor. It is thus possible to make a step-wise adjustment displacement, which will correspond to a stepwise adjustable motor speed and torque, for equal pressure and flow conditions for the motor.

U.S. Pat. No. 6,033,195 discloses a two-speed gerotor motor, where a sliding valve changes the oil flow between inlet/outlet and valving. This means that all volume chambers in the gear set will be interfered by shifting between two displacements, like in all known two-speed applications for gerotor motors. With the arrangement of FIG. 2, only the volume chamber connected to the pilot operated check valve 42 will be exposed to the shift in displacement, and not all the others chambers. Shifting with a running motor is thereby made much easier.

The shifting operation could be controlled in a time sequence, if the motor has more than one passage with a pilot-operated check valve. Shift from highest displacement to lowest displacement will thereby always occur stepwise, when the motor is running. Additionally, shifting of each pilot operated check valve could occur in a pulse modulated way, whereby the change in displacement will correspond to a ramp function, instead of a step function.

The instant invention focuses on the non-return valves 32 and the oil passage 30 in connection with the gear set 14. Additionally, this invention can be used in a multiple displacement motor, by adding the pilot-operated check valves 42. It is therefore seen that this application will achieve at least its stated objectives.

What is claimed is:

1. A rotary fluid pressure device of the type including housing having a fluid inlet port and a fluid outlet port; fluid pressure-operated displacement means associated with said housing, and including an internally-toothed ring member, and an externally-toothed star member eccentrically disposed within said ring member for relative orbital and rotational movement therebetween to define a plurality of expanding and contracting fluid volume chambers in response to said orbital and rotational movements, and minimum and maximum volume transition chambers; a valve member cooperating with said housing to provide fluid communication between said inlet port and said expanding volume chambers and between said contracting volume chambers and said outlet port; said valve member and said housing cooperating to define a nominal valve overlap; wherein the improvement comprises:

a first oil passage with relatively high pressure fluid therein surrounding the gear set, a plurality of second oil passageways connecting the first oil passageway to the expanding and contracting oil chambers, fluid non-return valves in each of the second oil passageways to permit the flow of oil therethrough only in a direction to the first oil passageway from the oil chambers; and a fluid valve means associated with the device and connected to the chambers by third fluid passageways, and pilot operated check valves are imposed in the third fluid passageways to permit fluid flow thereby only in a direction to the chambers from the fluid valve means.

* * * * *